US006322011B1

(12) United States Patent
Allen

(10) Patent No.: US 6,322,011 B1
(45) Date of Patent: Nov. 27, 2001

(54) ELECTROSTATIC COATING SYSTEM AND DUAL LIP BELL CUP THEREFOR

(75) Inventor: Harold T. Allen, Indianapolis, IN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/525,141

(22) Filed: Mar. 14, 2000

(51) Int. Cl.[7] ..... B05B 5/00; B05B 3/10; F23D 11/04

(52) U.S. Cl. ..... 239/703; 239/223; 239/224; 239/690; 239/591; 239/699; 239/700; 239/701; 239/702

(58) Field of Search ..... 239/223, 224, 239/591, 690, 699, 700, 701, 702, 703

(56) References Cited

U.S. PATENT DOCUMENTS

| | | | | |
|---|---|---|---|---|
| Re. 31,590 | | 5/1984 | Mitsui . | |
| 3,009,441 | | 11/1961 | Juvinall . | |
| 3,043,521 | | 7/1962 | Wampler . | |
| 3,083,911 | * | 4/1963 | Griffiths, Jr. | 239/223 X |
| 4,037,561 | * | 7/1977 | LaFave et al. | 239/15 X |
| 4,148,932 | | 4/1979 | Tada et al. . | |
| 4,744,513 | * | 5/1988 | Meisner et al. | 239/703 X |
| 4,784,332 | | 11/1988 | Takeuchi et al. . | |
| 4,854,506 | | 8/1989 | Noakes et al. . | |
| 4,896,834 | * | 1/1990 | Coeling et al. | 239/703 X |
| 5,078,321 | | 1/1992 | Davis et al. . | |
| 5,137,215 | * | 8/1992 | Degli | 239/223 |
| 5,433,387 | | 7/1995 | Howe et al. . | |
| 5,622,563 | | 4/1997 | Howe et al. . | |
| 5,820,036 | | 10/1998 | Saito . | |
| 5,947,377 | | 9/1999 | Hansinger et al. . | |

FOREIGN PATENT DOCUMENTS

| | | | | |
|---|---|---|---|---|
| 2659428 | * | 7/1978 | (DE) | 239/700 |

* cited by examiner

*Primary Examiner*—Robin O. Evans
(74) *Attorney, Agent, or Firm*—John H. Pilarski; Roland K. Bowler, II; Mark W. Croll

(57) ABSTRACT

An electrostatic coating system having a rotary atomizing device formed of a non-conductive body member having an opening in an outer end thereof, a semiconductive member is disposed on a side portion of the body member, a first lip devoid of the semiconductive member is disposed about the opening of the body member proximate the outer end thereof, and a second lip is disposed radially outwardly of the first lip, between the first lip and the inner end of the body member.

19 Claims, 1 Drawing Sheet

ELECTROSTATIC COATING SYSTEM AND DUAL LIP BELL CUP THEREFOR

BACKGROUND OF THE INVENTION

The invention relates generally to electrostatic coating systems, and more particularly to electrostatic coating systems having improved bell cups.

Electrostatic coating systems having rotating atomizing devices, some of which are known as bell cups, that dispense charged and atomized coating material toward target articles are known generally, as disclosed for example in U.S. Pat. No. 5,622,563 entitled "Nonincendive Rotary Atomizer", which is assigned commonly with the present application.

Electrostatically charged coating materials dispensed from rotating atomizers, particularly metal and high speed non-metal non-incendiary bell cups, however have a tendency to wrap back around toward an outer side of the atomizer cup, which has an adverse effect on the transfer efficiency of the coating material.

An object of the present invention is to provide novel electrostatic coating systems and rotating atomizing devices therefor and combinations thereof that improve upon and overcome problems in the art.

Another object of the invention is to provide novel electrostatic coating systems and rotating atomizing devices therefor and combinations thereof that are reliable and economical.

Another object of the invention is to provide novel electrostatic coating systems and rotating atomizing devices therefor and combinations there of having improved efficiency.

A further object of the invention is to provide novel electrostatic coating systems and rotating atomizing devices therefor and combinations thereof that comply with industry safety standards.

Another object of the invention is to provide novel electrostatic coating systems and rotating atomizing devices therefor and combinations thereof that reduce the tendency of charged and atomized coating material to wrap back around the rotary atomizing device.

A more particular object of the invention is to provide novel electrostatic coating system bell cups comprising a non-conductive body member having an opening formed in an outer end thereof, a semiconductive member on a side portion of the body member, a first lip devoid of the semiconductive member disposed about the opening of the body member proximate the outer end thereof, a second lip disposed between the first lip and the inner end of the body member, the second lip disposed radially outwardly of the first lip.

Another more particular object of the invention is to provide novel electrostatic rotary atomizing devices comprising a non-conductive body member having an opening in an outer end thereof, a generally cylindrical first side portion extending from the outer end of the body member toward an inner end thereof, a generally cylindrical second side portion between the first side portion of the body member and the inner end thereof, a third side portion interconnecting the first and second generally cylindrical side portions, and a semiconductive coating on the second side portion of the body member, the first side portion of the body member devoid of the semiconductive coating.

Yet another more particular object of the invention is to provide novel electrostatic coating systems that dispense charged and atomized coating material from a rotary atomizing device, comprising a non-conductive body member having an outer end with an opening therein from which the coating material is dispensed, the body member having a generally cylindrical first side portion with a first diameter, the first side portion of the body member extending from the outer end thereof toward an opposite inner end thereof, the body member having a generally cylindrical second side portion with a second diameter greater than the first diameter of the first side portion, the second side portion of the body member is disposed between the first side portion of the body member and the inner end thereof, and a semiconductive coating on the second side portion of the body member, the first side portion of the body member is devoid of the semiconductive coating.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
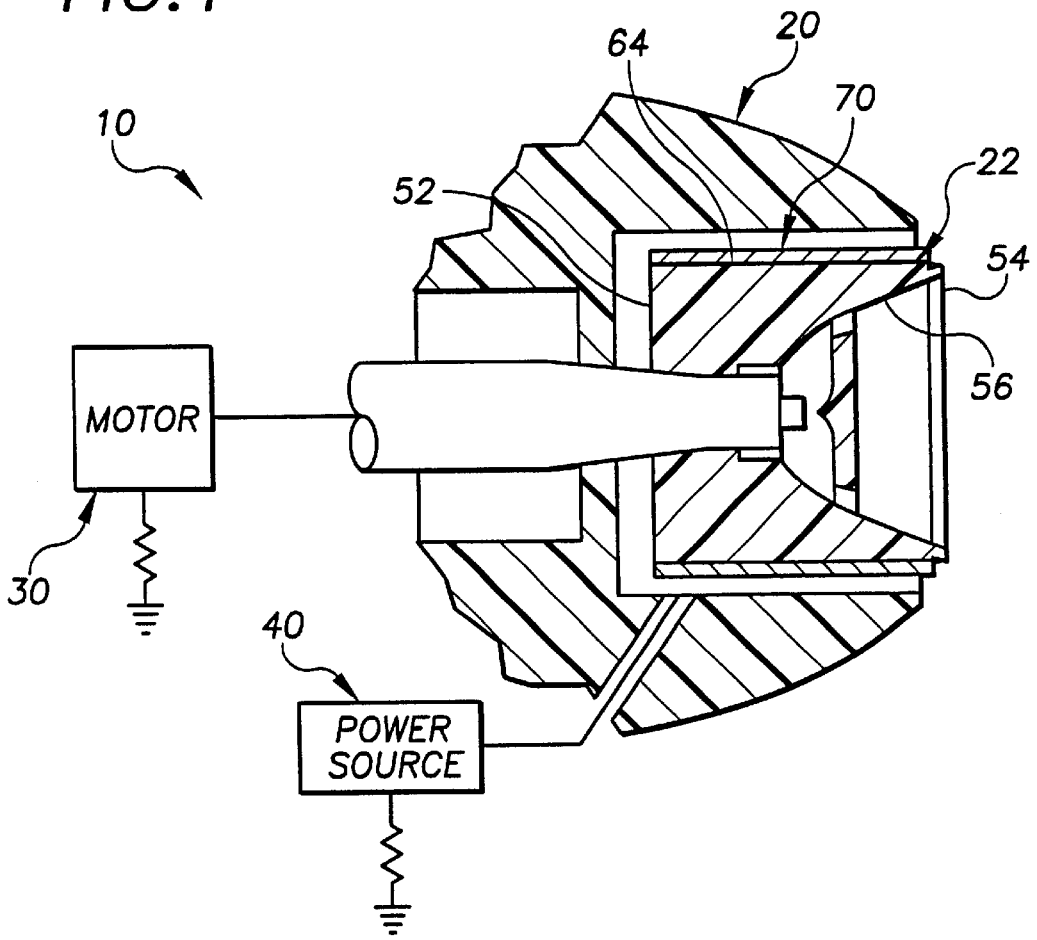
FIG. 1 is an electrostatic system according to the present invention.

FIG. 1 illustrates an electrostatic coating system 10 comprising an electrostatic applicator 20 having a rotary atomizing device or bell cup 22 that dispenses charged and atomized coating material toward a target article, not shown in the drawing, at an electrical potential, usually electrical ground potential, that is different from that of the coating material.

The system comprises a motor 30 or some other rotary drive member that imparts rotation to the rotary atomizing device 22, as disclosed for example in the referenced U.S. Pat. No. 5,622,563 entitled "Non-incendive Rotary Atomizer", which is assigned commonly herewith and incorporated herein by reference.

The rotary applicator 20 is coupled to a high voltage source 40 for direct or indirect charging of the coating material, also disclosed in the referenced U.S. Pat. No. 5,622,563 entitled "Non-incendive Rotary Atomizer".

In the exemplary embodiment, the bell cup 22 comprises a non-conductive body member 50 having an inner end 52 and an opposite outer end 54 with an opening 56 having a generally conical form in the exemplary embodiment disposed therein and from which the atomized coating material is dispensed.

The body member 50 is preferably formed of a resinous or a filled resin material, for example a glass filled polyetheretherketone (PEEK) or other suitable material, some of which are disclosed for example in the referenced U.S. Pat. No. 5,622,563 entitled "Nonincendive Rotary Atomizer", but may also be formed of other non-conductive materials.

Figure 2:
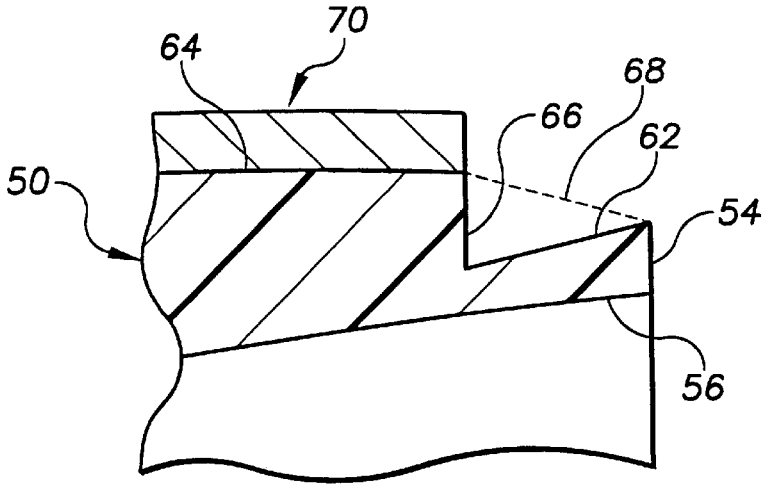
FIG. 2 is an enlarged view of a portion of a rotary bell cup of FIG. 1.

In FIG. 2, the exemplary body member 50 has a generally cylindrical first side portion 62 with a corresponding first diameter extending from the outer end 54 of the body member generally axially toward the inner end thereof. In the exemplary embodiment, the diameter of the first generally cylindrical side portion 62 of the body member increases toward the outer end 54 of the body member so that the first side portion 62 has a generally conical shape in correspondence with the generally conical opening 56 formed therein.

The body member 50 also has a generally cylindrical second side portion 64, with a corresponding second diameter that is greater than the first diameter of the first generally cylindrical side portion 62. In FIG. 1, the second side portion 64 of the body member is disposed between the first side portion 62 of the body member and the inner end 52 thereof.

The body member 50 generally comprises a first lip disposed about the opening 56 thereof proximate or on the outer end 54 thereof, and a second lip disposed radially outwardly of the first lip, between the first lip and the inner end 52 of the body member.

In FIG. 2, the first lip is formed at least partially by the outer end 54 of the body member and the first side portion 62 thereof. And the second lip is formed at least partially by the second side portion 64 of the body member and a third side portion of the body member between the second side portion 64 and the outer end 54 thereof.

In the exemplary embodiment of FIG. 2, the third side portion of the body member is a generally annular radial portion 66 of the body member located between and interconnecting the first and second side portions 62 and 64 thereof.

Alternatively, the third side portion 66 is not necessarily disposed radially from the axis of the bell cup as in the exemplary embodiment. The third side portion 66 may for example be a generally conical surface extending from the second side portion 64 toward the outer end 54 of the body member, and in one configuration it extends to the outer end 54 so that the first and third side portions form a common surface as indicated by phantom line 68.

A semiconductive member 70 is disposed on at least a portion of the generally cylindrical side portion of the body member 50. The semiconductive member is preferably a semiconductive coating or thin film applied to a portion of the body member, as disclosed in the referenced U.S. Pat. No. 5,622,563 entitled "Nonincendive Rotary Atomizer".

The first lip of the body member is preferably devoid of the semiconductive coating. In the exemplary embodiment of FIGS. 1 and 2, the semiconductive coating is disposed on the second side portion 64 of the body member 50 but not on the first side portion 62 thereof. The third side portion 66 of the body member in the exemplary embodiment is also devoid of the semiconductive coating, but in some alternative embodiments the third side portion of the body member may include the semiconductive coating.

A rotary atomizer having the exemplary form and/or the variations thereof disclosed herein eliminate or substantially reduce the tendency of the charged and atomized coating material to wrap back around the side portions thereof, thereby remarkably improving coating material transfer efficiency.

The spacing between the first and second lips, for example the difference between the diameters of the first and second side portions 62 and 64 of the body member as represented by the third side portion 66 thereof, and the axial dimension of the first side portion 62 of the body member devoid of the semiconductive coating material, are preferably selected to optimize the transfer efficiency of the coating material dispensed from the atomizing device 22. These particular dimension however are application specific, depending for example on the geometry of the article to be coated and the properties of the coating material among other factors, and are readily ascertainable without undue experimentation by those of ordinary skill in the art based on the disclosure herein.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An electrostatic coating system rotary bell cup comprising:

anon-conductive body member having an inner end, an opposite outer end, and first second and third generally cylindrical exterior side portions, the first exterior side portion of the body member extending from the outer end of the body member toward the inner end thereof, the second exterior side portion of the body member located between the first exterior side portion of the body member and the inner end thereof, the third exterior side portion of the body member disposed between the first and second exterior side portions thereof, the second exterior side portion of the body member disposed radially outwardly of the first exterior side portion thereof;

a semiconductive member disposed on at least a portion of the second exterior side portion of the body member, the first and third exterior side potions of the body member devoid of the semiconductive member;

a first lip disposed about the opening of the body member proximate the outer end thereof, the first lip formed at least partially by the first exterior side portion of the body member adjacent the outer end thereof;

a second lip disposed between the first lip and the inner end of the body member, the second lip disposed radially outwardly of the first lip and formed at least partially by the second and third extexior side portions of the body member.

2. The bell cup of claim 1, the first lip formed by the outer end of the body member and the first exterior side portion thereof, the outer end of the body member devoid of the semiconductive member.

3. The bell cup of claim 1, the body member is partially disposed in an electrostatic applicator housing.

4. The bell cup of claim 1, the first exterior side portion of the body member having a diameter less than the second exterior side portion thereof.

5. The bell cup of claim 4, the third exterior side portion of the body member extending generally transversely between the first and second exterior side portions thereof.

6. The bell cup of claim 4, the first exterior side portion of the body member having a generally conical shape increasing in diameter toward the outer end of the body member, a generally conical opening in the outer end of the body member.

7. The bell cup of claim 4, the semiconductive member is a semiconductive film.

8. An electrostatic rotary atomizing device comprising:

a non-conductive body member having an inner end and an opposite outer end with an opening therein, the body member having a generally cylindrical first exterior side portion extending from the outer end thereof toward the inner end thereof, a generally cylindrical second exterior side portion between the first exterior side portion of the body member and the inner end thereof, and a third exterior side portion of the body member interconnecting the first and second exterior side portions thereof;

a semiconductive coating on the second exterior side portion of the body member, the first exterior side portion of the body member devoid of the semiconductive coating.

9. The device of claim 8, the third exterior side portion of the body member devoid of the semiconductive coating.

10. The device of claim 8, the first exterior side portion of the body member having a first diameter and the second exterior side portion of the body member having a second diameter greater than the first diameter of the first exterior side portion thereof.

11. The device of claim 10, the third exterior side portion of the body member extending generally radially between the first and second exterior side portions thereof and devoid of the semiconductive coating.

12. The device of claim 8, a diameter of the first exterior side portion of the body member increasing toward the outer end thereof.

13. An electrostatic coating system that dispenses charged and atomized coating material from a rotary atomizing device, comprising:

a non-conductive body member having an inner end and an opposite outer end with a generally conical opening therein from which the coating material is dispensed, the body member having a generally cylindrical first exterior side portion with a first diameter, the first exterior side portion of the body member extending from the outer end thereof toward the inner end thereof, the body member having a generally cylindrical second exterior side portion with a second diameter greater than the first diameter of the first exterior side portion, the second exterior side portion of the body member disposed between the first exterior side portion of the body member and the inner end thereof;

a semiconductive coating on the second exterior side portion of the body member the first exterior side portion of the body member devoid of the semiconductive coating.

14. The system of claim 13, the body member having a third exterior side portion interconnecting the first and second exterior side portions thereof.

15. The system of claim 14, the third exterior side portion of the body member devoid of the semiconductive coating.

16. The system of claim 14, the third exterior side portion of the body member extending generally radially between the first and second exterior side portions thereof and devoid of semiconductive coating material.

17. The system of claim 13, the diameter of the first exterior side portion of the body member increasing toward the outer end thereof.

18. The system of claim 14, the third exterior side portion of the body member extending transversely between the first and second exterior side portions thereof.

19. The system of claim 14, the diameter of the first exterior side portion increasing toward the outer end of the body member.

* * * * *